US008294054B2

(12) United States Patent
Chiu

(10) Patent No.: US 8,294,054 B2
(45) Date of Patent: Oct. 23, 2012

(54) DRAINING DEVICE FOR AIR CONTROL EQUIPMENT

(75) Inventor: Ming-Tsung Chiu, Chung-Ho (TW)

(73) Assignee: New Widetech Industries Co., Ltd., Taipei Hsien (TW)

( * ) Notice: Subject to any disclaimer, the term of this patent is extended or adjusted under 35 U.S.C. 154(b) by 580 days.

(21) Appl. No.: 12/587,262

(22) Filed: Oct. 5, 2009

(65) Prior Publication Data

US 2011/0079035 A1 Apr. 7, 2011

(51) Int. Cl.
*H01H 3/42* (2006.01)

(52) U.S. Cl. ..... 200/573

(58) Field of Classification Search ..... 137/203, 137/101.21, 115.26, 560; 62/285, 291, 298, 62/303; 200/51.07, 51.08, 51.13, 500, 573, 200/51.09

See application file for complete search history.

(56) References Cited

U.S. PATENT DOCUMENTS 4,855,041 A * 8/1989 Church et al. ..... 137/203
5,583,327 A * 12/1996 Black, III ..... 137/560
7,556,058 B2 * 7/2009 Chiu ..... 137/560

* cited by examiner

*Primary Examiner* — Craig Schneider
*Assistant Examiner* — Craig J Price
(74) *Attorney, Agent, or Firm* — William E. Pelton, Esq.; Cooper & Dunham LLP

(57) ABSTRACT

A draining device for air control equipment has a bottom shell, a top shell, a knob, a switch and a connecting device. The bottom and top shells are connected to each other. The top shell has two inclined recesses. The knob is mounted through the top shell and has two sliding protrusions mounted in the inclined recesses and two tabs. The switch is mounted in the bottom shell and has a button. The connecting device has a connecting tube, a flange and an end protrusion. The connecting tube is mounted through the top shell. The flange is formed around the connecting tube and is mounted across the tabs. The end protrusion abuts the button. When the knob is rotated, the sliding protrusions move along the inclined recesses to force the knob moving downward. Therefore, the end protrusion pushes the button to turn on the switch.

14 Claims, 6 Drawing Sheets

DRAINING DEVICE FOR AIR CONTROL EQUIPMENT

BACKGROUND OF THE INVENTION

1. Field of the Invention

The present invention relates to a draining device, especially to a draining device for air control equipment to drain out the water.

2. Description of the Prior Arts

Air control equipment such as air conditioners and dehumidifiers are widely used to regulate room temperature and humidity. The air control equipment has a storage tank to contain the absorbed water. When the water in the storage tank is full, the air control equipment signals an alarm and automatically stops absorbing surplus water in the air. Once the storage tank has been emptied, the air control equipment may be restarted. However, frequently emptying the storage tank is inconvenient and at night or when out, people cannot empty the storage tank so the air control equipment remains off and damage may be inflected on clothes, artwork or the like.

To overcome the shortcomings, the present invention provides a draining device for air control equipment to mitigate or obviate the aforementioned problems.

SUMMARY OF THE INVENTION

The main objective of the present invention is to provide a simplified draining device for easy use. The draining device for air control equipment has a bottom shell, a top shell, a knob, a switch and a connecting device. The bottom and top shells are connected to each other. The top shell has two inclined recesses. The knob is mounted through the top shell and has two sliding protrusions mounted in the inclined recesses and two tabs with opposite inclined sides. The switch is mounted in the bottom shell and has a button. The connecting device has a connecting tube, a flange and an end protrusion. The connecting tube is mounted through the top shell. The flange is formed around the connecting tube and is mounted across the tabs. The end protrusion abuts the button. When the knob is rotated, the sliding protrusions move along the inclined recesses to force the knob to move downward. Therefore, the end protrusion pushes the button to turn on the switch.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
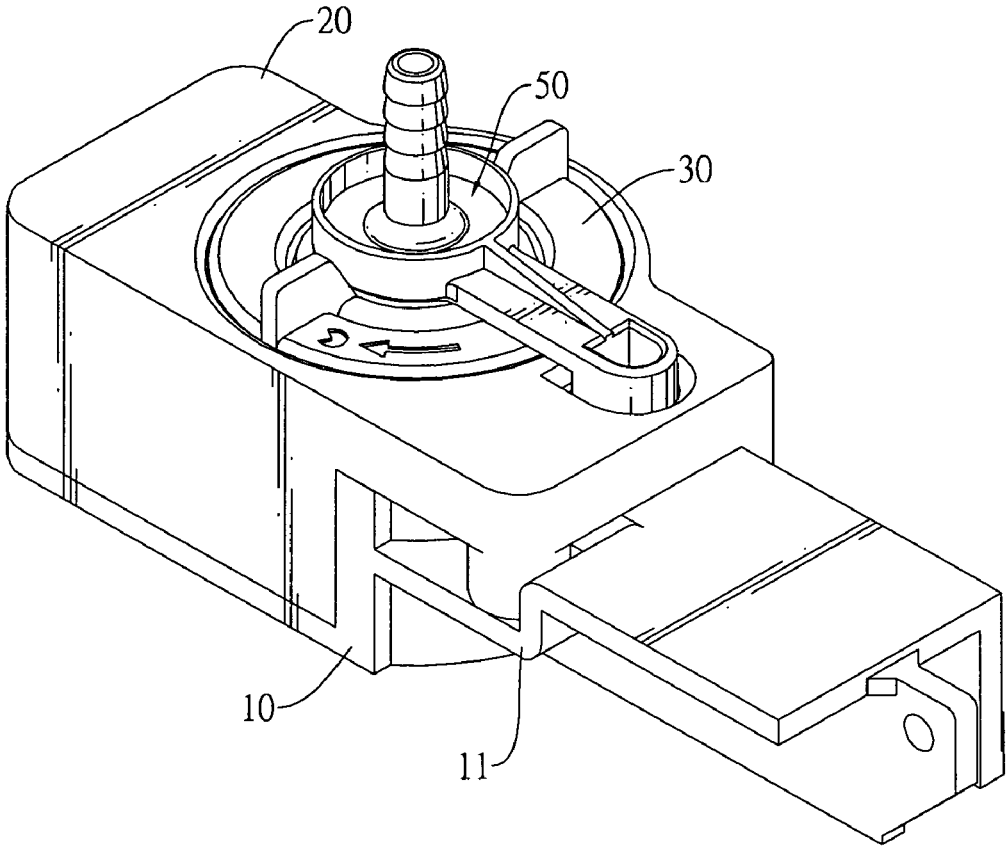
FIG. 1 is a perspective view of a draining device for air control equipment in accordance with the present invention.
Figure 2:
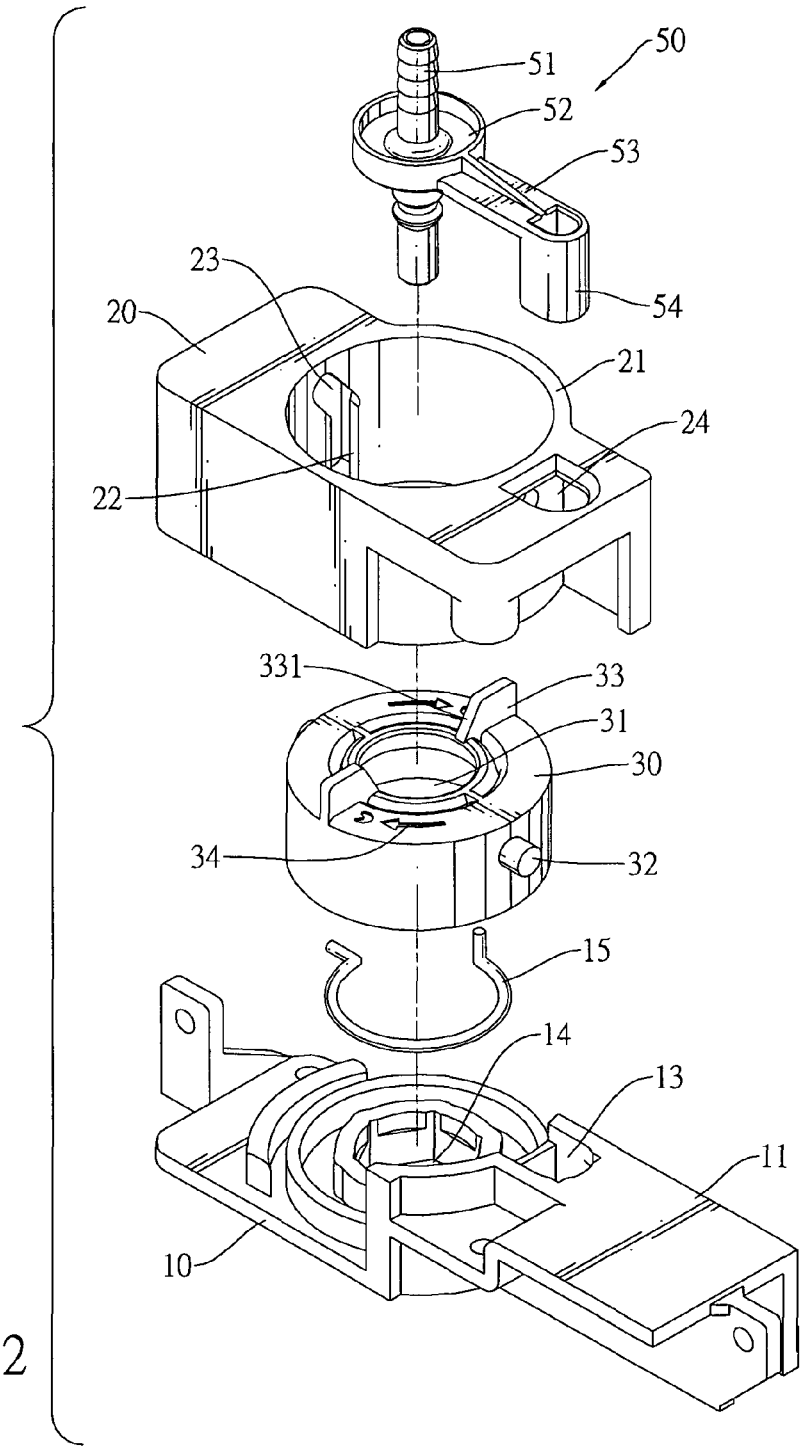
FIG. 2 is an exploded perspective view of the draining device in FIG. 1.
Figure 3:
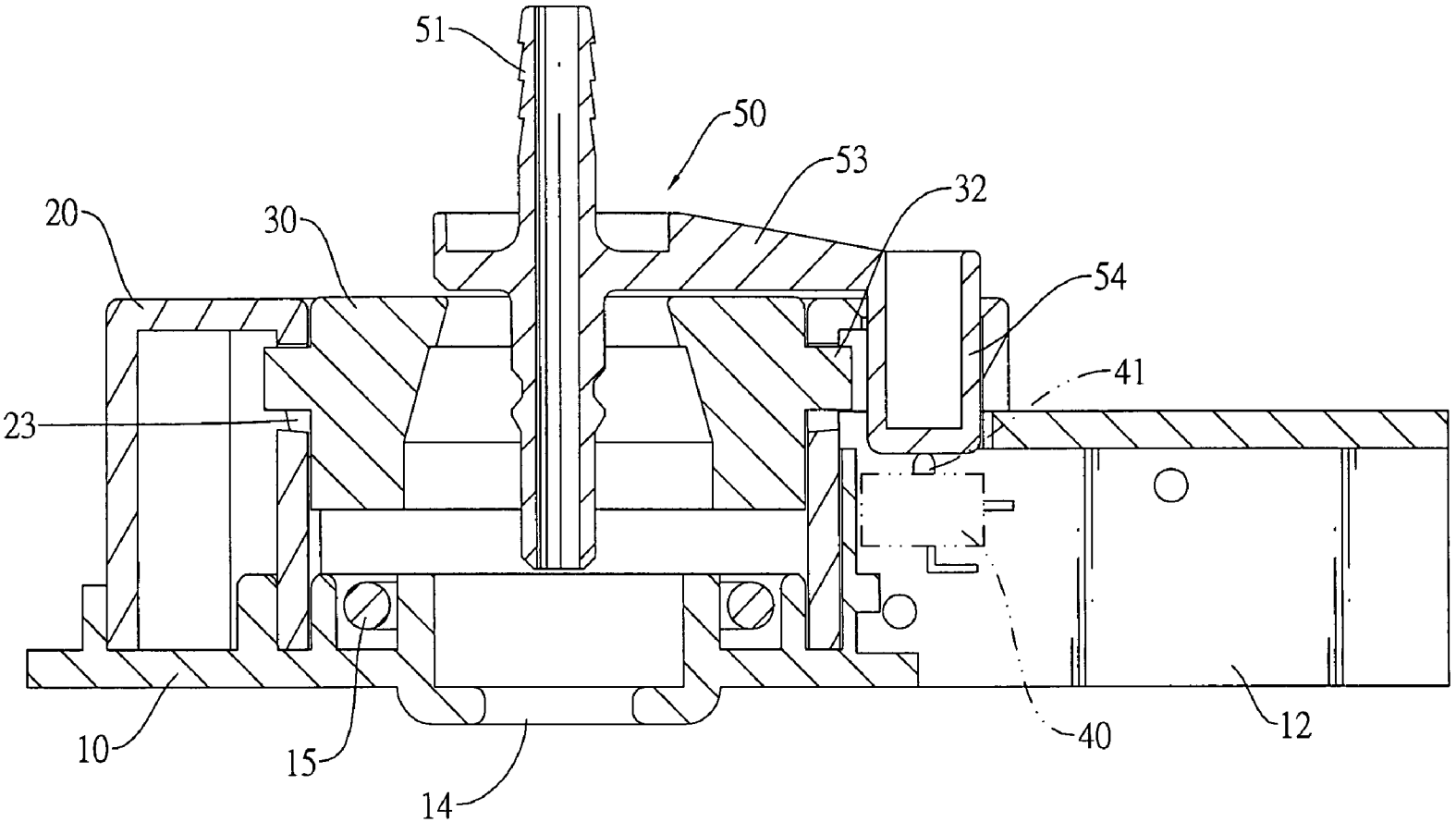
FIG. 3 is a side view in partial section of the draining device in FIG. 1.

With reference to FIGS. 1 to 3, a draining device for an air control equipment in accordance with the present invention comprises a bottom shell (10), a top shell (20), a knob (30), a switch (40) and a connecting device (50).

The bottom shell (10) has a bracket (11), a cavity (12) and a draining hole (14). The bracket (11) is formed on a side of the bottom shell (10) and has a through hole (13). The cavity (12) is defined under the bracket (11). The draining hole (14) is formed through a bottom surface of the bottom shell (10). The spring (15) is mounted on the bottom shell (10) and is mounted around the draining hole (14).

The top shell (20) is covered on a top of the bottom shell (10) and has a sleeve part (21), two slits (22), two inclined recesses (23) and a connecting hole (24). The sleeve part (21) is hollow and communicates with the draining hole (14) of the bottom shell (20). The slits (22) are formed through an inside wall of the sleeve part (21) and are directly opposite each other. Each inclined recess (23) is formed in the inside wall of the sleeve part (21) and is formed in a top of one slit (22). The inclined recesses (23) are inclined toward opposite directions. The connecting hole (24) is formed through a top surface of the top shell (20) and aligns with the through hole (13) of the bottom shell (10).

The knob (30) is mounted in the sleeve part (21) of the top shell (20) from a bottom of the slits (22) of the top shell (20) and has a central hole (31), two sliding protrusions (32), two tabs (33) and at least one index (34). The central hole (31) communicates with the draining hole (14) of the bottom shell (10). The sliding protrusions (32) are formed on and protrude transversely from an outside wall of the knob (30) and are directly opposite each other. Each sliding protrusion (32) is mounted slidably in one inclined recess (23) of the top shell (20). The tabs (33) are formed on a top surface of the knob (30) and are directly opposite each other. Each tab (33) has an inner inclined side (331). The inner inclined sides (331) of the tabs (33) face each other. A bottom distance between bottom edges of the inner inclined sides (331) of the tabs (33) is smaller than a top distance between top edges of the inner inclined sides (331) of the tabs (33).

The switch (40) is mounted in the cavity (12) of the bottom shell (10), is electrically connected to a motor to actuate the motor and has a button (41). The button (41) corresponds to the through hole (13) of the bottom shell (10).

The connecting device (50) has a connecting tube (51), a flange (52) and an extension rod (53). The connecting tube (51) is mounted through the central hole (31) of the knob (30), communicates with the draining hole (14) of the bottom shell (10) and directly connects to the outer drain pipe. The flange (52) is formed around the connecting tube (51) and is mounted across the inner inclined sides (331) of the tabs (33) of the knob (30). The extension rod (53) is formed on and protrudes out from the flange (32) and has an end protrusion (54). The end protrusion (54) is mounted through the connecting hole (24) of the top shell (20) and the through hole (13) of the bottom shell (10) and abuts the button (41) of the switch (40).

Figure 4:
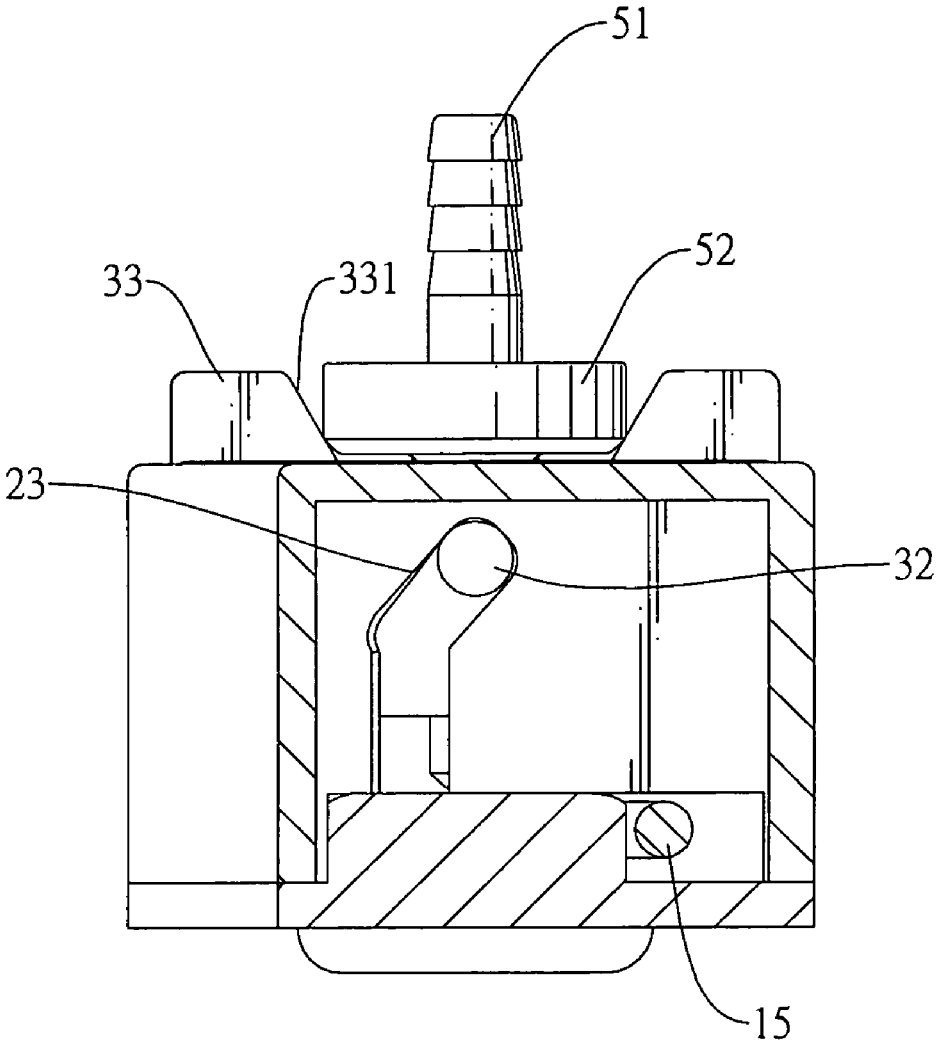
FIG. 4 is an end view in partial section of the draining device in FIG. 1.

With reference to FIGS. 3 and 4, the sliding protrusions (32) of the knob (30) are near the top edges of the inclined recesses (23). The flange (52) of the connecting device (50) is held by the tabs (33) to keep the end protrusion (54) from pushing the button (41). Therefore, the switch (40) is off.

Figure 5:
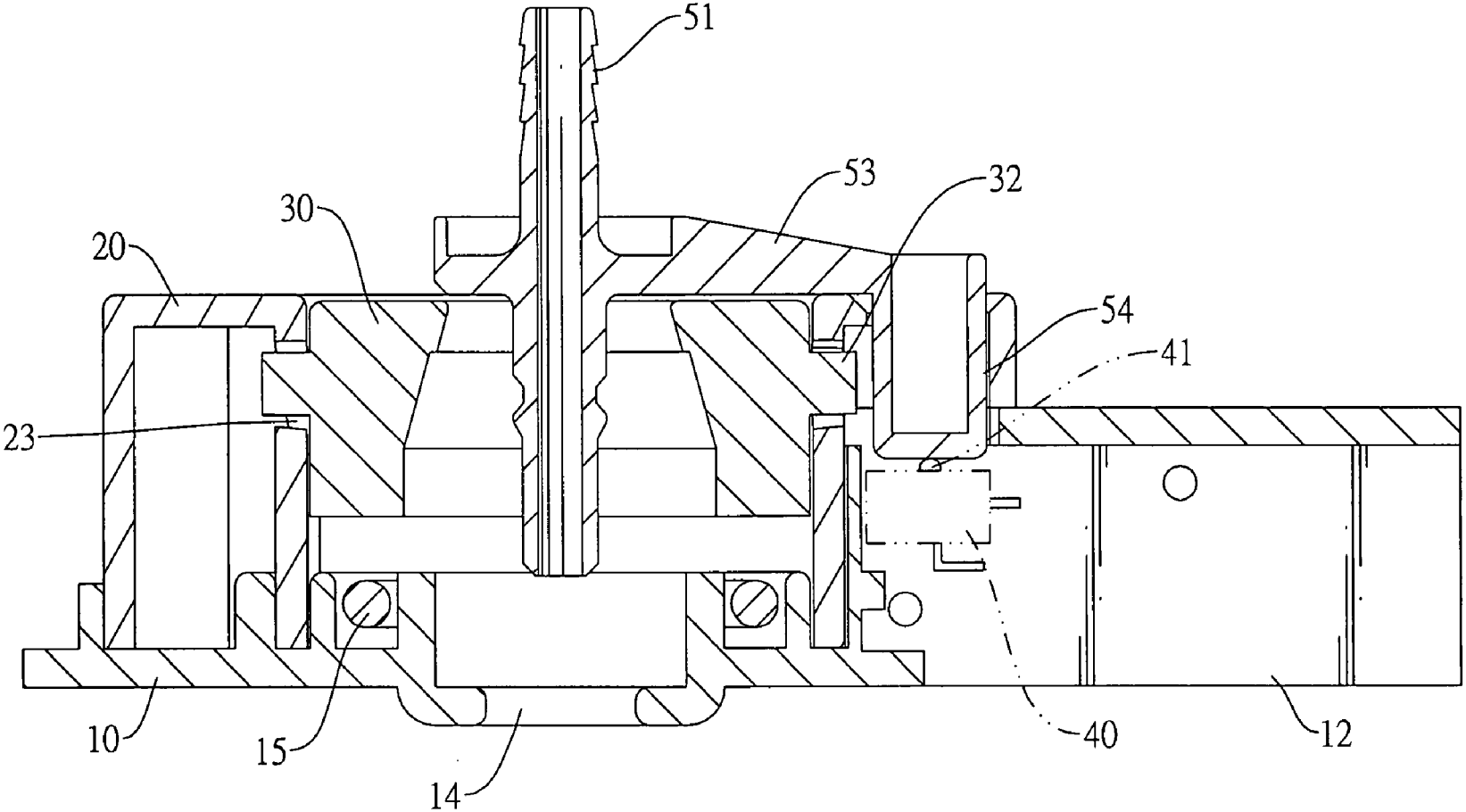
FIG. 5 is an operational side view in partial section of the draining device in FIG. 1.
Figure 6:
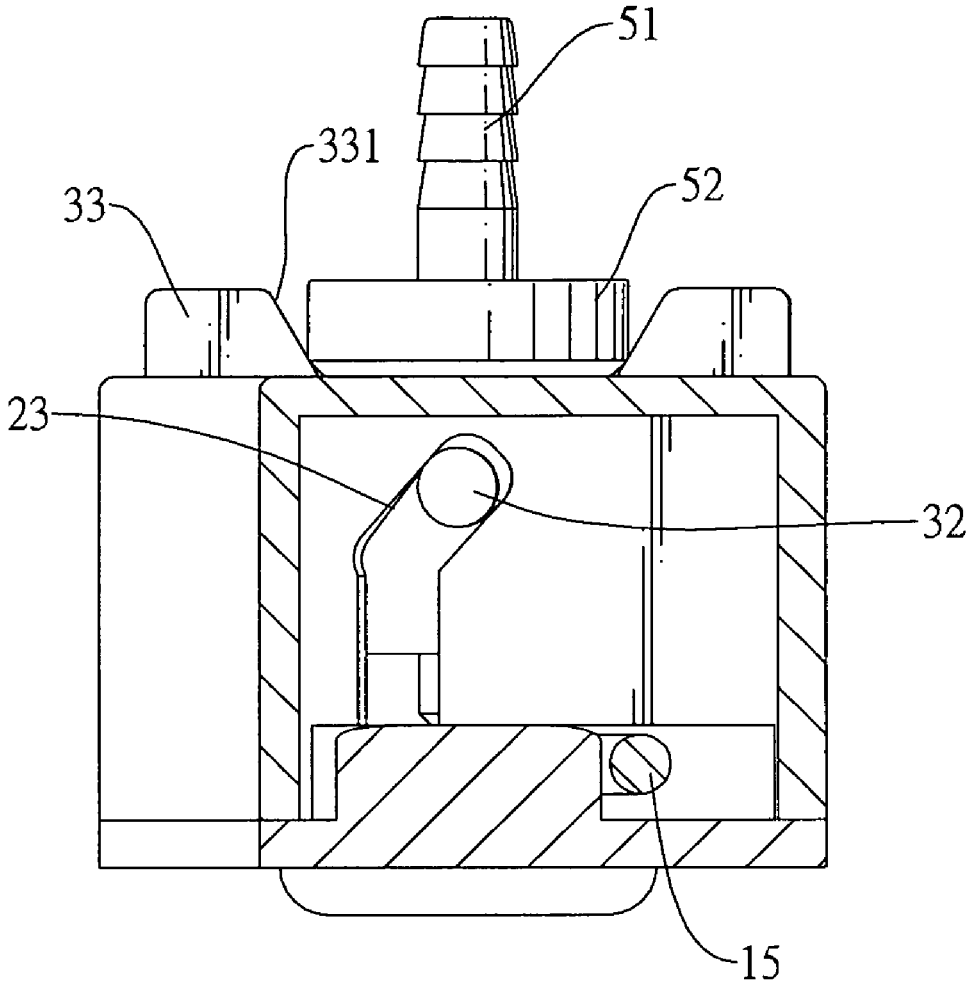
FIG. 6 is an operational end view in partial section of the draining device in FIG. 1.

With reference to FIGS. 5 and 6, the knob (30) is rotated. The sliding protrusions (32) move along the inclined recesses (23) to force the knob (30) moving downward. The flange (52) of the connecting device (50) falls downward since the knob (30) moves downward and the end protrusion (54) pushes the button (41) to turn on the switch (40). Therefore, the motor is started to drain the water out through the draining hole (14).

The draining device as described has following advantages. With the cooperation between the knob (30) and the inclined recesses (23), the switch (40) is easily turned on to start draining the water. The whole structures are simplified and easy to operate.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A draining device for air control equipment comprising:
a bottom shell having a draining hole formed through a bottom surface of the bottom shell;
a top shell covered on a top of the bottom shell and having
a sleeve part being hollow and communicating with the draining hole of the bottom shell; and
two inclined recesses formed in an inside wall of the sleeve part;
a knob mounted in the sleeve part and having
a central hole communicating with the draining hole of the bottom shell;
two sliding protrusions formed on and protruding transversely from an outside wall of the knob, and each sliding protrusion mounted slidably in one inclined recess of the top shell; and
two tabs formed on a top surface of the knob, and each tab having an inner inclined side, and the inclined sides of the tabs facing to each other, wherein a bottom distance between bottom edges of the inner inclined sides of the tabs is smaller than a top distance between top edges of the inner inclined sides of the tabs;
a switch mounted in the bottom shell and having a button; and
a connecting device having
a connecting tube mounted through the central hole of the knob and communicating with the draining hole of the bottom shell;
a flange formed around the connecting tube and mounted across the inner inclined sides of the tabs of the knob; and
an extension rod formed on and protruding out from the flange and having
an end protrusion mounted through the top shell and the bottom shell and abutting the button of the switch.

2. The draining device as claimed in claim 1, wherein
the top shell has two slits formed through an inside wall of the sleeve part; and
each inclined recess of the top shell is formed in a top of one slit.

3. The draining device as claimed in claim 2, wherein
the slits of the top shell are directly opposite each other; and
the sliding protrusions of the knob are directly opposite each other.

4. The draining device as claimed in claim 1, wherein
the bottom shell has
a bracket formed on a side of the bottom shell and having a through hole; and
a cavity defined under the bracket;
the top shell has a connecting hole formed through a top surface of the top shell and aligning with the through hole of the bottom shell;
the switch is mounted in the cavity of the bottom shell;
the button of the switch corresponds to the through hole of the bottom shell; and
the end protrusion of the connecting device is mounted through the connecting hole of the top shell and the through hole of the bottom shell.

5. The draining device as claimed, in claim 2, wherein
the bottom shell has
a bracket formed on a side of the bottom shell and having a through hole; and
a cavity defined under the bracket;
the top shell has a connecting hole formed through a top surface of the top shell and aligning with the through hole of the bottom shell;
the switch is mounted in the cavity of the bottom shell;
the button of the switch corresponds to the through hole of the bottom shell; and
the end protrusion of the connecting device is mounted through the connecting hole of the top shell and the through hole of the bottom shell.

6. The draining device as claimed in claim 3, wherein
the bottom shell has
a bracket formed on a side of the bottom shell and having a through hole; and
a cavity defined under the bracket;
the top shell has a connecting hole formed through a top surface of the top shell and aligning with the through hole of the bottom shell;
the switch is mounted in the cavity of the bottom shell;
the button of the switch corresponds to the through hole of the bottom shell; and
the end protrusion of the connecting device is mounted through the connecting hole of the top shell and the through hole of the bottom shell.

7. The draining device as claimed in claim 1, wherein the tabs of the knob are directly opposite each other.

8. The draining device as claimed in claim 2, wherein the tabs of the knob are directly opposite each other.

9. The draining device as claimed in claim 3, wherein the tabs of the knob are directly opposite each other.

10. The draining device as claimed in claim 4, wherein the tabs of the knob are directly opposite each other.

11. The draining device as claimed in claim 5, wherein the tabs of the knob are directly opposite each other.

12. The draining device as claimed in claim 6, wherein the tabs of the knob are directly opposite each other.

13. The draining device as claimed in claim 1, wherein a spring is mounted on the bottom shell and is mounted around the draining hole.

14. The draining device as claimed in claim 12, wherein a spring is mounted on the bottom shell and is mounted around the draining hole.

* * * * *